US009718593B2

(12) United States Patent
Gillespie

(10) Patent No.: US 9,718,593 B2
(45) Date of Patent: Aug. 1, 2017

(54) FOOD PACKAGING HAVING AN INTEGRATED SPOUT

(71) Applicant: General Mills, Inc., Minneapolis, MN (US)

(72) Inventor: Scott F. Gillespie, Maple Grove, MN (US)

(73) Assignee: General Mills, Inc., Minneapolis, MN (US)

( * ) Notice: Subject to any disclaimer, the term of this patent is extended or adjusted under 35 U.S.C. 154(b) by 82 days.

(21) Appl. No.: 14/531,452

(22) Filed: Nov. 3, 2014

(65) Prior Publication Data

US 2016/0122089 A1 May 5, 2016

(51) Int. Cl.
*B65D 77/38* (2006.01)
*B65D 75/58* (2006.01)
(Continued)

(52) U.S. Cl.
CPC ..... *B65D 75/5811* (2013.01); *B65B 61/02* (2013.01); *B65B 61/18* (2013.01); *B65D 75/5866* (2013.01); *B65D 31/18* (2013.01); *B65D 35/08* (2013.01); *B65D 35/44* (2013.01); *B65D 47/106* (2013.01);
(Continued)

(58) Field of Classification Search
CPC ..... B65D 35/02; B65D 35/04; B65D 35/06; B65D 35/08; B65D 35/38; B65D 65/18; B65D 83/12; B65D 1/023; B65D 1/0238; B65D 85/60; B65D 47/10; B65D 47/103; B65D 47/106; B65D 2577/2075; B65D 2577/2083; B65D 75/5805; B65D 75/5811; B65D 75/5822; B65D 75/5827; B65D 75/5861; B65D 75/5866; B65D 35/00; B65D 35/10; B65D 35/44; B65D 47/36; B65D 77/10; B65D 77/12; B65D 77/38; B65D 75/5816; B65D 31/16; B65D 31/18; B65B 61/20; B65B 61/18
USPC ..... D9/707; 222/92–107, 541.1–541.9, 222/153.06, 572; 383/38, 207–209; 229/87.06, 927, 87.05, 117.3, 117.31,
(Continued)

(56) References Cited

U.S. PATENT DOCUMENTS 3,083,876 A * 4/1963 Schneider ..... B65D 75/5822 206/820
3,200,996 A * 8/1965 Picatti ..... B05C 17/005 222/107

(Continued)

*Primary Examiner* — Paul R Durand
*Assistant Examiner* — Andrew P Bainbridge
(74) *Attorney, Agent, or Firm* — Paul J. LaVanway, Jr.; Annette M. Frawley, Esq.

(57) ABSTRACT

A food package container may have an integrated spout that can be used to dispense the contents of the container into a consumer's mouth. In some examples, the food package container includes an elongated, flexible-wall container body providing a tubular chamber holding a foodstuff. The container has a spout formed by a narrowing of the container body in a region extending upwardly away from the tubular chamber. For example, spout may be bound on one side by the container body and further bound on an opposite side and on a top edge by a seal joining opposed walls of the container body together. To open the spout, a weakened line may extend laterally across the container body adjacent the top edge of the spout and longitudinally across the container body adjacent the side of the spout bound by the seal.

25 Claims, 5 Drawing Sheets

(51) Int. Cl.

| | |
|---|---|
| ***B65B 61/02*** | (2006.01) |
| ***B65B 61/18*** | (2006.01) |
| *B65D 35/44* | (2006.01) |
| *B65D 77/12* | (2006.01) |
| *B65D 35/08* | (2006.01) |
| *B65D 47/10* | (2006.01) |
| *B65D 30/28* | (2006.01) |

(52) U.S. Cl.
CPC ..... *B65D 75/5805* (2013.01); *B65D 75/5833* (2013.01); *B65D 77/12* (2013.01)

(58) Field of Classification Search
USPC ..... 229/307, 313–314; 426/119–120, 115, 426/122–123
See application file for complete search history.

(56) References Cited

U.S. PATENT DOCUMENTS 3,388,836 A * 6/1968 Otto ..... B65D 75/5805 222/107
4,644,732 A * 2/1987 Morton ..... B65D 75/5816 383/121
4,717,046 A * 1/1988 Brogli ..... B65D 75/20 206/484
4,974,732 A * 12/1990 Sullivan ..... B65D 75/008 206/484
D347,993 S 6/1994 Lane et al.
5,371,997 A * 12/1994 Kopp ..... B65D 75/5805 53/133.8
D354,906 S 1/1995 Lane et al.
5,465,707 A 11/1995 Fulcher et al.
D375,676 S 11/1996 Davis et al.
5,593,229 A * 1/1997 Warr ..... B65D 33/08 383/10
5,630,308 A * 5/1997 Guckenberger ..... B23K 26/067 53/412
D386,398 S 11/1997 Davis
5,803,350 A 9/1998 Benet
5,931,345 A * 8/1999 Lane, Jr. ..... B05C 17/00583 222/105
6,126,317 A * 10/2000 Anderson ..... B65D 75/5827 229/87.05
6,206,278 B1 3/2001 Cornell et al.
6,244,467 B1 * 6/2001 Lewit ..... B65D 55/16 222/107
6,340,088 B1 * 1/2002 Mouri ..... B65D 75/566 206/720
6,402,379 B1 * 6/2002 Albright ..... B65D 75/5816 383/209
D478,276 S 8/2003 Mobs et al.
6,702,462 B2 * 3/2004 Richardson ..... B65D 75/566 222/107
7,241,066 B1 * 7/2007 Rosen ..... A46B 11/0003 206/459.5
7,306,370 B2 * 12/2007 Howell ..... B31B 19/90 383/204
D574,259 S 8/2008 Rosskamp
7,581,371 B2 * 9/2009 Owensby ..... B65D 75/5811 206/466
D620,372 S 7/2010 Latour
D630,522 S 1/2011 Harvey et al.
D643,745 S 8/2011 Hartley
8,007,174 B2 8/2011 Yamaguchi et al.
D645,761 S 9/2011 Latour et al.
D662,833 S 7/2012 Sanfilippo et al.
8,459,504 B2 6/2013 Braxton et al.
D688,567 S 8/2013 Stronski
D747,975 S * 1/2016 Gillespie ..... D9/707
9,314,813 B2 * 4/2016 Pritchard ..... B05C 17/00583
2007/0051727 A1 3/2007 Holley, Jr.
2008/0099504 A1 5/2008 Cunningham et al.
2009/0181133 A1 * 7/2009 Luber ..... B65D 75/40 426/108
2009/0291244 A1 11/2009 Kihara et al.
2010/0008602 A1 * 1/2010 Risgalla ..... B65D 75/5822 383/44
2010/0166924 A1 * 7/2010 Leathersich ..... B65D 75/5805 426/122
2011/0062223 A1 3/2011 Wall et al.
2012/0213456 A1 * 8/2012 Sugiyama ..... B65D 75/5805 383/207
2013/0084028 A1 4/2013 Cross
2014/0037807 A1 2/2014 Delane
2014/0044381 A1 * 2/2014 Ulstad ..... B65D 75/5866 383/207

* cited by examiner

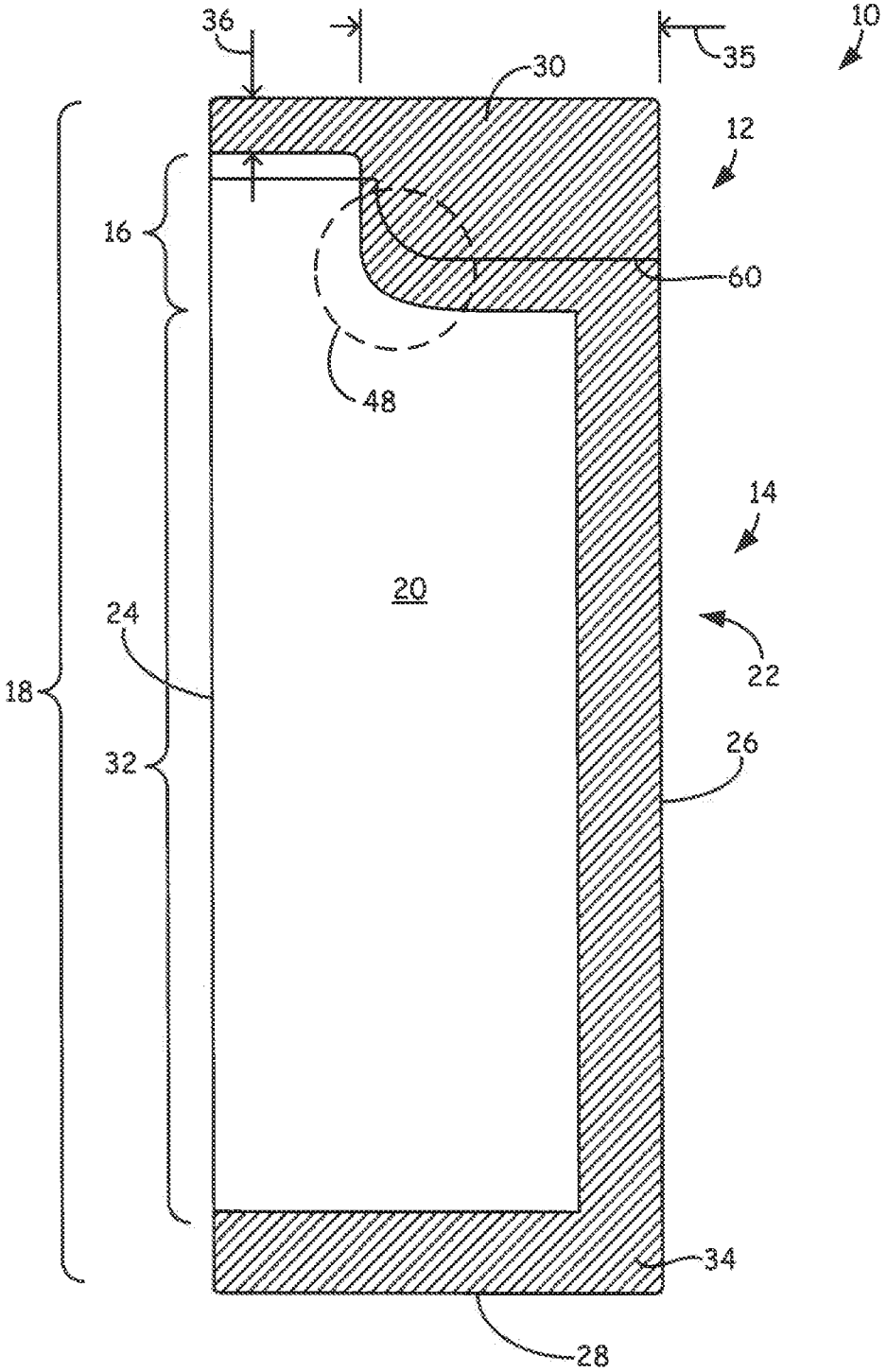
Fig. 1
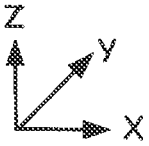

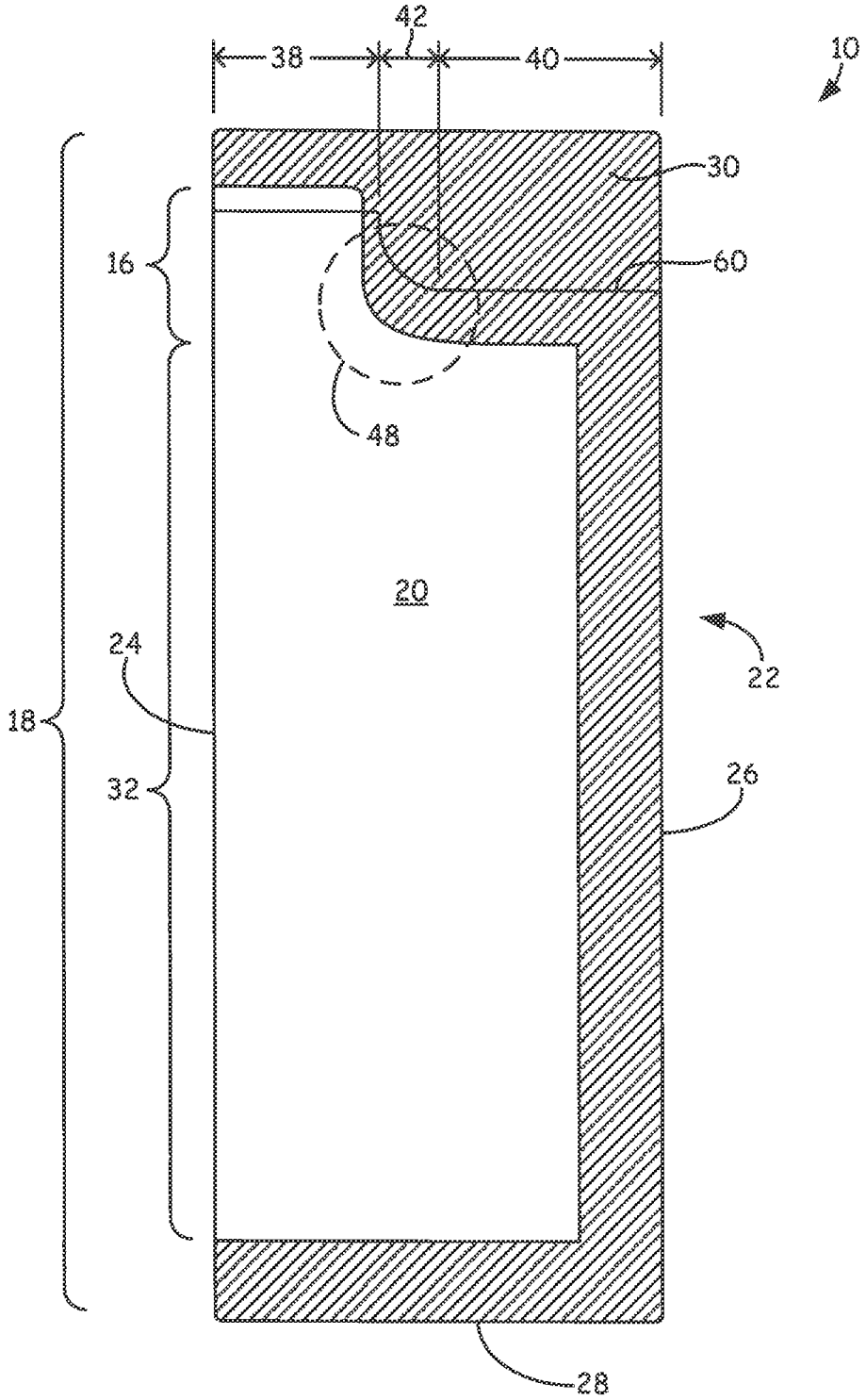
Fig. 3
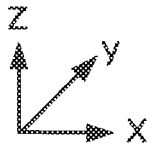

FOOD PACKAGING HAVING AN INTEGRATED SPOUT

TECHNICAL FIELD

This disclosure relates to containers and, more particularly, to human-consumable food product containers having an integrated spout that can be accessed by a consumer.

BACKGROUND

The time and schedule demands placed on individuals in modern society often require that they eat on the go and in locations lacking full food preparation facilities. In response to this need, food manufacturers have provided traditional food products in transportable packaging arrangements that can be opened and consumed away from home, such as at work or school, without needing secondary containers, utensils, or other appliances found at home. As one example, a portable yogurt product sold by Yoplait® under the trade name GoGurt® is supplied in a plastic tube and can be consumed without a spoon. To consume the product, the consumer can cut and/or tear the end off the tube, insert the open end of the tube into their mouth, and then squeeze the contents directly into their mouth. This arrangement eliminates the need for a spoon, making the product convenient to consume away from home.

It is common for food manufacturers to provide food products in a variety of different size containers. This allows the purchaser to select a size of product suitable for the intended consumer and sufficient to satisfy their appetite. For example, a purchaser selecting a product for her family may purchase one size container for a younger child and then switch to a larger size container as the child grows and ages.

Manufacturers of food products delivered in tube containers can increase the size of their tube containers to increase the volume of product provided to the consumer. However, convenience and portability may be limited if a tube container becomes either too long or too wide. If the tube container is too long, it may not fit conveniently in a lunch box or other carrier taken by the consumer on the go. Similarly, if the tube container is too wide, it may not fit conveniently in the consumer's mouth for dispensing product.

SUMMARY

In general, this disclosure is directed to a container for holding a human-consumable food product, such as a viscous foodstuff cultured dairy product (e.g., yogurt, yogurt mousse, gellified milk, fresh cheese, sour cream) and that has a spout built into a wall of the container. The spout can provide a narrower cross-section than a remainder of the container body. For example, the spout may taper in cross-sectional width between the container body and an outlet end of the spout. In use, a consumer can tear off a terminal edge of the container, opening the outlet end of the spout to communicate with a surrounding environment. The consumer can then insert the outlet end of the spout into their mouth and dispense the food product from the container body, through the spout, and into their mouth.

In some examples, the act of tearing off the terminal edge of the container functions to both open the outlet end of the spout and to cause the spout to project from the remainder of the container body. For example, the spout may be formed by sealing different sections of the container body together, with the seals bounding one or more edges of the spout from a remainder of the container body. The removable terminal edge of the container may extend over the outlet end of the spout and down an edge of the spout. When so configured, the terminal edge of the container can tear off laterally across the outlet end of the spout and longitudinally down the edge of the spout, leaving the spout projecting from a remainder of the container body. This arrangement can be useful so the spout does not project away from the remainder of the container body during storage and transport, in which case the spout could inadvertently catch on a surface and tear. This arrangement can also be useful so the removable terminal edge of the container body reinforces the spout from breaking open during storage and transport.

While the configuration of the container can vary, in some examples, the container is formed of a flexible-wall container having a forwardly-facing sidewall and a rearwardly-facing sidewall. The two sidewalls may be joined together to form a tubular chamber containing a human-consumable foodstuff. The container can have a spout forming a narrowing region of the container extending upwardly away from the tubular chamber. The spout may be bound collectively by a side edge of the container, a first or top seal region, and a side or transition seal region that connects the top seal region to the opposite side edge of the container. The seal regions can be formed by bonding the forwardly-facing sidewall and rearwardly-facing sidewall together within the seal region.

In addition, to facilitate opening of the container, the container can have a weakened line (e.g., a tear line) dividing the container into a removable upper section and remaining lower section that includes the tubular chamber containing the human-consumable foodstuff. The weakened line can extend laterally across the container body below the first or top seal region and longitudinally across the container body between the side or transition seal region and the opposite side edge of the container from the side edge bounding the spout. Accordingly, when tearing the container along the weakened line, the first or top seal region closing the spout can tear off, opening the spout to dispense the human-consumable foodstuff. Further, the side or transition seal region can also tear off, causing the spout to project from the remainder of the container body. This arrangement can provide a tubular chamber containing a comparatively large amount of human-consumable foodstuff desired by many consumers connected to a narrower spout that can fit conveniently in the consumer's mouth for dispensing product.

In one example, a food product is described that includes an elongated, flexible-wall container body providing a tubular chamber holding a viscous human-consumable foodstuff and having a dispensing spout formed by a narrowing of the elongated, flexible-wall container body in a region extending upwardly away from the tubular chamber. The example specifies that the dispensing spout is bound on one side by a side edge of the elongated, flexible-wall container body that also bounds the tubular chamber, the dispensing spout being further bound on an opposite side of the peripheral edge and on a top edge connecting the peripheral edge to the opposite side of the dispensing spout by a seal joining opposed walls of the elongated, flexible-wall container body together. The example also specifies that the elongated, flexible-wall container body includes a tear line extending along two axes, including laterally across the elongated, flexible-wall container body adjacent the top edge of the dispensing spout and longitudinally across the elongated, flexible-wall container body adjacent the opposite side of the dispensing spout from the peripheral edge.

In another example, a method is described that includes filling an elongated, flexible-wall container with a viscous human-consumable foodstuff through an open end of the elongated, flexible-wall container. The method further includes pressing opposed walls of the elongated, flexible-wall container in a region of the open end between sealing jaws, thereby sealing the open end of the elongated, flexible-wall container and forming a dispensing spout, the dispensing spout being bound on one side by a side edge of the elongated, flexible-wall container and further bound by the sealing formed during pressing on an opposite side of the peripheral edge and on a top edge connecting the peripheral edge to the opposite side of the dispensing spout. The method further includes forming a tear line extending along two axis of the elongated, flexible-wall container, including laterally across the elongated, flexible-wall container adjacent the top edge of the dispensing spout and longitudinally across the elongated, flexible-wall container adjacent the opposite side of the dispensing spout from the peripheral edge.

In another example, a container for a human-consumable foodstuff is described that includes an elongated container body having a forwardly-facing sidewall and a rearwardly-facing sidewall that, in combination, bound a chamber for containing a human-consumable foodstuff. The example states that the forwardly-facing sidewall and the rearwardly-facing sidewall extend from a lower end of the elongated container body to an upper end of the elongated container body. The example also specifies that the container includes a seal joining the forwardly-facing sidewall to the rearwardly-facing sidewall adjacent the upper end of the elongated container body, the seal including a first seal region extending laterally across the elongated container body at a first location between the upper end and the lower end, a second seal region extending laterally across the elongated container body at a second location positioned closer to the lower end than the first location, and a transition seal region extending longitudinally across the elongated container body and connecting the first seal region to the second seal region. In addition, the example states that the seal defines a spout bound collectively by a side edge of the elongated container body, the first seal region, and the transition seal region. Further, the example specifies that the elongated container body includes a weakened line dividing the elongated body into a removable upper section and a remaining lower section, where the weakened line extends laterally across the elongated container body above the second seal region, longitudinally across the elongated container on an opposite side of the transition seal region from the spout, and laterally across the elongated container body below the first seal region, such that, when the elongated container body is torn open along the weakened line, the spout has a dispensing opening at a location previously sealed by the first seal region.

The details of one or more examples are set forth in the accompanying drawings and the description below. Other features, objects, and advantages will be apparent from the description and drawings, and from the claims.

BRIEF DESCRIPTION OF DRAWINGS

FIGS. 1 and 2 are illustrations of an example food product container that can be used to hold and dispense a human-consumable foodstuff.

FIG. 3 is another illustration of the container shown in FIGS. 1 and 2 with certain reference numerals removed for purposes of discussion.

DETAILED DESCRIPTION

In general, this disclosure relates to an elongated, flexible-wall container having a spout formed by joining opposed forwardly-facing and rearwardly-facing sidewalls of the container together. The joined sections of the forwardly-facing and rearwardly-facing sidewalls define seal regions that bound the flexible-wall container (e.g., such that foodstuff cannot flow through the seal regions). The seal regions narrow the cross-sectional width of the container to form a spout incorporated into the flexible-wall container structure. The seal regions can also enclose and seal the spout such that foodstuff does not flow through the spout to the external environment before intended by a consumer.

To open the elongated, flexible-wall container, the container may include a weakened line that tears preferentially to a remainder of the container structure. In use, a consumer can grasp a removable portion of the elongated, flexible-wall container and a remaining portion of the container separated by the weakened line and move the two portions in opposed directions, causing the container to physically separate along the weakened line. This can detach the removable portion of the elongated, flexible-wall container from the remaining portion, opening the spout to dispense the contents of the container.

By appropriately arranging the weakened line relative to the seal regions, the removable portion may separate from the remainder of the elongated, flexible-wall container so as to both open the spout and to cause the spout to extend away from a larger container body holding foodstuff. When so configured, the removable portion can seal the spout closed and may help protect the spout prior to use, e.g., such that the spout does not project away from the elongated, flexible-wall container but rather is enclosed within the container structure.

Figure 2:
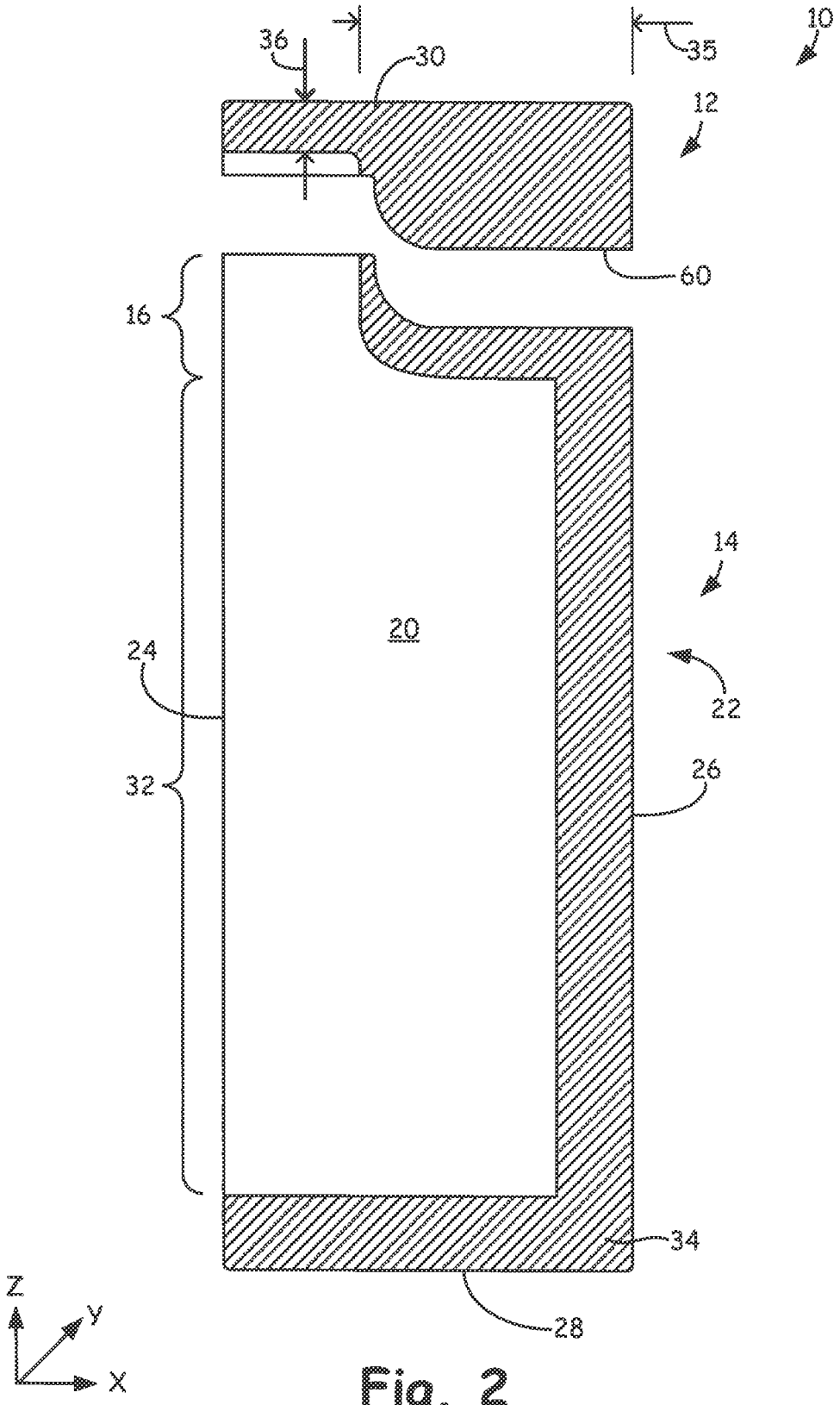

FIGS. 1 and 2 are illustrations of an example food product container 10 (referred to as "container 10") that can be used to hold and dispense a human-consumable foodstuff. Container 10 is formed of a removable upper section 12 and a remaining lower section 14. FIG. 1 illustrates upper section 12 and lower section 14 physically joined together to form an integrated, unitary container structure capable of holding a sealed foodstuff. FIG. 2 illustrates upper section 12 detached and physically separated from lower section 14, as would occur when a user separates upper section 12 from lower section 14 to access the contents of the container.

As described in greater detail below, container 10 includes a spout 16 through which a food product can be dispensed during use of container 10. Spout 16 may form a tube or region of lower section 14 having a smaller cross-sectional area than a remainder of container 10 to which the spout is fluidly connected. In some examples, spout 16 is sized such that a user (e.g., a human child and/or adult) can insert the spout into their mouth and dispense the contents of container 10 directly into their mouth through the spout. The remainder of container 10 may or may not be of sufficiently large size such that a user would find it uncomfortable or infeasible to insert the entire cross-section of the container in their mouth, were spout not present.

Container 10 can be used to store and dispense any desired materials, including edible food products or non-edible products. In various examples, container 10 may be used to store and dispense viscous foodstuffs such as fresh dairy products (e.g., yogurt, cheese, cream, mousse, dressing, custard, pudding, ice cream, frozen yogurt), fruit preparations (e.g., jellies, gelatins, apple or other fruit sauce, fruit purees, honey), dessert sauces (e.g., chocolate or caramel sauce), or the like. For instance, container 10 may be used to store and dispense a viscous yogurt, such as a yogurt having a viscosity ranging from 10,000 centipoise to 200,000 centipoise (e.g., 15,000 centipoise to 25,000 centipoise) at 40° F. Product viscosity can be measured at 40° F. using a Brookfield viscometer (Brookfield Engineering Laboratories, MA, USA) with a T-bar spindle 94 on the Helipath™ setting. In other applications, container 10 can be used to store and dispense non-edible product, such as oils, greases, creams, paints, pigments, polishes, and the like. Regardless of product stored in container 10, the container may also contain air or another filling gas introduced into the container while filling the desired product prior to sealing. Other products can be stored and dispensed from container 10, and it should be appreciated that the disclosure is not limited in this respect.

In the example of FIGS. 1 and 2, container 10 includes a container body 18 formed of a forwardly-facing sidewall 20 and a rearwardly-facing sidewall 22 opposite the forwardly-facing sidewall. Forwardly-facing sidewall 20 may physically intersect and/or join rearwardly-facing sidewall 22 to define a first side edge 24 and a second side edge 26 opposite the first side edge. In some examples, first side edge 24 and/or second side edge 26 are side regions of container body 18 where forwardly-facing sidewall 20 is bonded (e.g., heat sealed, sonically welded, adhesively bonded) to rearwardly-facing sidewall 22. For example, in the configuration of FIGS. 1 and 2, second side edge 26 is illustrated as being a bonded region joining forwardly-facing sidewall 20 to rearwardly-facing sidewall 22.

In other examples, first side edge 24 and/or second side edge 26 may not contain a bond between forwardly-facing sidewall 20 and rearwardly-facing sidewall 22 but may instead be a joining region between the two sidewalls. For example, as further shown in the configuration of FIGS. 1 and 2, first side edge 24 is illustrated as being a joining region between forwardly-facing sidewall 20 and rearwardly-facing sidewall 22 that does not include a bond between the two sidewalls. When configured as shown in the example of FIGS. 1 and 2, container body 18 can have a well-defined first side edge 24 and second side edge 26 when the container body is devoid of product and collapsed. Upon filling container body 18 with product, however, first side edge 24 may bulge outwards to provide a radius of curvature connecting forwardly-facing sidewall 20 from an oppositely facing rearwardly-facing sidewall 22.

Container body 18 is configured to hold a desired product, including those example products discussed above. Container body 18 may be sized and shaped as an elongated structure. For example, container body 18 may have a length (e.g., in the Z-direction indicated on FIGS. 1 and 2) greater than a width (e.g., in the X-direction indicated on FIGS. 1 and 2) and depth (e.g., in the Y-direction indicated on FIGS. 1 and 2). The length of container body 18 can be the dimension extending perpendicular to ground from the lower end 28 to the upper end 30 (e.g., in the Z-direction indicated on FIGS. 1 and 2), when container 10 is oriented upright (e.g., with respect to gravity). For example, container body 18 may configured as a tubular structure providing an elongated channel housing product. This may provide a convenient size and shape that fits in a bag or lunch box for consumers on the go.

Independent of the length of container body 18 relative to the width and depth, the container body can have any suitable cross-sectional configuration (e.g., in the X-Y plane indicated on FIGS. 1 and 2), including any polygonal shape, arcuate shape, or even combinations of polygonal and arcuate shapes. In various examples, container body 18 can have a generally square, oval, rectangular, circular, triangular, or other shape. Furthermore, the cross-section of container body 18 may vary along the length of the body, for example, taping adjacent lower end 28 and/or upper end 30. For instance, in the configuration of FIGS. 1 and 2, container body 18 is shown as being an elongated cylinder having a generally circular cross-sectional shape with second side edge 26 projecting away from the cylinder (e.g., in the X-direction indicated on FIGS. 1 and 2).

Container body 18 in the example of FIGS. 1 and 2 forms a chamber 32 for containing a desired product, such as a human-consumable foodstuff, that is in fluid communication with spout 16. Chamber 32 may extend from lower end 28 of container body 18 toward upper end 30 of the container body (e.g., in the positive Z-direction indicated on the figure). For example, chamber 32 can be the enclosed region of container body 18 bound collectively by forwardly-facing sidewall 20, rearwardly-facing sidewall 22, first side edge 24, and second side edge 26. Chamber 32 may be further bound on a bottom side by a sealed bottom edge 34. Chamber 32 may extend upward toward upper end 30 until container body 18 transitions into spout 16. For example, chamber 32 may terminate at a location along the length of container body 18 where the cross-sectional area of the container body (e.g., in the X-Y plane) begins to get smaller relative to the remainder (e.g., middle) section of the container body, defining the starting location of spout 16.

Independent of the specific configuration of chamber 32, the chamber can define a bound cavity (prior to removing upper section 12) sealed on an upper end by the closure of spout 16 and on the lower end by bottom edge 34. Chamber 32 can receive and hold product and fluidly communicate the product with spout 16. For example, in use, product held in chamber 32 can be advanced upwardly toward spout 16 and can be dispensed out of the spout (e.g., when upper section 12 is removed as shown in FIG. 2).

When chamber 32 is sealed (e.g., with upper section 12 attached as shown in FIG. 1), a desired product can partially or fully fill the chamber. For example, when oriented vertically upwards with respect to gravity, chamber 32 may be substantially or completely filled with a desired product while spout 16 is substantially devoid of product and is instead filled with a gas (e.g., air, carbon dioxide, nitrogen). In other examples, the desired product can completely fill chamber 32 and extend up into spout 16. The filling level of container 10 may vary depending on manufacturer preferences and filling tolerances.

Chamber 32 is connected to spout 16 to form a continuous, fluidly connected cavity extending between bottom edge 34 of container body 18 and spout 16. Spout 16 may form a narrowing in cross-sectional width or area (e.g., in the X-Y plane indicated on FIGS. 1 and 2) of container body 18, providing a more conveniently sized orifice for dispensing product into a consumer's mouth than if product were dispensed across the entire cross-sectional width or area. In different examples, spout may have a width (e.g., in the X-direction indicated on FIGS. 1 and 2) less than ½ the width of the container body (e.g., maximum width), such as less than ⅓ the width of container body 18, or less than ¼ the width of the container body. In these examples, the length of spout 16 may be at least 1/20 the overall length of container body 18 (e.g., the combined length of chamber 32 and spout 16), such as at least 1/10 the overall length of the container body, at least 1/7 the overall length of the container body, or at least 1/5 the overall length of the container body, such as from 1/15 to 1/7 the overall length of the container body.

In some examples, spout 16 has a substantially constant cross-sectional width across its length. In other examples, spout 16 has a variable cross-sectional width across its length. In the example of FIGS. 1 and 2, for examples, spout 16 extends laterally away from first side edge 24 of container body 18 as the spout extends downwardly away from the top edge of the container body. As a result, the spout increases in a cross-sectional area as the spout moves downwardly from the top edge of container body 18.

Typically, container 10 will be fabricated from a flexible-wall material so as to form a flexible-wall container body 18. A flexible-wall container body 18 may be formed of relatively thin, sheet-like walls that can expand outwardly (when introducing product into chamber 32) and collapse inwardly (when dispensing product from chamber 32 via spout 16) without changing the thickness dimensions of the walls. For example, forwardly-facing sidewall 20 and rearwardly-facing sidewall 22 of flexible-wall container body 18 may collapse towards each other when container 10 is empty but expand away from each other when the internal volume of the container is filled with product. In subsequent use, a consumer can physically and manually squeeze forwardly-facing sidewall 20 and rearwardly-facing sidewall 22 toward each other, causing the sidewalls to collapse together and discharge product through spout 16. In this way, the contents of container 10 can be dispensed through spout 16 by squeezing the sidewalls of the container together at a progressively increasing vertically elevated position along the length of container body 18.

As briefly discussed above, spout 16 can be incorporated into container 10 by joining sections of forwardly-facing sidewall 20 and rearwardly-facing sidewall 22 together in one or more seal regions through which product cannot flow. The one or more seal regions can narrow the cross-sectional width of container body 18 to form spout 16 and also seal the spout prior to use. In some examples, the seal regions are formed by pressing forwardly-facing sidewall 20 and rearwardly-facing sidewall 22 together while heating the sidewalls to a temperature sufficient to melt-bond the inside faces of the sidewalls together, thereby heat sealing the sidewalls together in the regions where the sidewalls are heated and pressed together. In other examples, forwardly-facing sidewall 20 and rearwardly-facing sidewall 22 can be adhesively bonded together, ultrasonically welded together, or otherwise structurally joined so as to form seal regions that seal an interior of container 10 from fluid communication with an exterior environment.

Although the configuration of spout 16 can vary, in the example of FIGS. 1 and 2, spout 16 is positioned to extend vertically upwardly away from chamber 32 along the lateral side of container body 18. For example, spout 16 is shown as being bound on one side by first side edge 24 of container body 18. First side edge 24 in this example also bounds chamber 32 so as to provide a continuous side edge of container body 18 extending vertically upwardly and bounding both chamber 32 and spout 16. When so configured, the side edge bounding chamber 32 is co-linear (e.g., and/or co-planar) with the side edge bounding spout 16. Such a configuration may be useful to provide a continuous side edge without transition along which product can flow as it travels from chamber 32 out through spout 16. While spout 16 is illustrated as sharing first side edge 24 with chamber 32, in other examples, spout can be positioned on an opposite side of container 10 such that the spout shares second side edge 26 with chamber 32.

Irrespective of the side of container body 18 along which spout 16 is positioned, forwardly-facing sidewall 20 may be bonded to rearwardly-facing sidewall 22 in the region of container body 18 opposite the side edge spout 16 shares with chamber 32. This bonded region can delimit the lateral extent of spout 16 and narrow the cross-sectional area of the spout (e.g., in the X-Y plane indicated on FIGS. 1 and 2) relative to the larger cross-sectional area of chamber 32. For example, in the configuration of FIGS. 1 and 2, forwardly-facing sidewall 20 is bonded to rearwardly-facing sidewall 22 in a seal region 35 extending laterally across container body 18 (in the X-direction indicated on FIGS. 1 and 2) from second side edge 26 of container body 18 to the lateral side of spout 16 opposite first side edge 24. In other words, seal region 35 delimits the opening size of spout 16 through which product can flow, forming a side wall of spout 16 opposite first side edge 24. Seal region 35 may also delimit the vertical extent of chamber 32 in the region adjacent spout 16.

To seal spout 16 prior to consumer use of container 10, forwardly-facing sidewall 20 may be bonded to rearwardly-facing sidewall 22 in a region of container body 18 located vertically on top of spout 16. For example, in FIGS. 1 and 2, forwardly-facing sidewall 20 is bonded to rearwardly-facing sidewall 22 in a seal region 36 extending longitudinally (in the Z-direction indicated on FIGS. 1 and 2) on top of spout 16. Spout can form a dispensing aperture upon removing seal region 36 from container 10. However, by bonded forwardly-facing sidewall 20 to rearwardly-facing sidewall 22 in seal region 36, spout is sealed from upper end 30 to a longitudinal side of spout 16. That is, seal region 36 delimits the vertical extent of spout 16.

Seal region 35 laterally delimiting spout 16 and seal region 36 longitudinally delimiting spout 16 can have a variety of different configurations. FIG. 3 is another illustration of container 10 as shown in FIG. 1 with certain reference numerals of FIG. 1 removed for purposes of discussion. As shown in the example of FIG. 3, the portion of forwardly-facing sidewall 20 that is bonded to rearwardly-facing sidewall 22 to define and close spout 16 includes three regions to form a seal. Specifically, in the illustrated example, the portion of forwardly-facing sidewall 20 that is bonded to rearwardly-facing sidewall 22 forms a first seal region 38, a second seal region 40, and a third seal region 42. First seal region 38 extends laterally across container body 18 at a first vertical location between upper end 30 and lower end 28, delimiting the vertical extent of spout 16 (in the Z-direction indicated on FIG. 3). Second seal region 40 extends laterally across container body 18 at a second vertical location positioned closer to lower end 28 than the first location, delimiting the vertical extent of chamber 32 at a lower height (in the Z-direction indicated on FIG. 3) than the vertically delimited extent of spout 16. Third seal region 42 functions as a transitional seal region connecting first seal region to second seal region. Third seal region 42 extends longitudinally across container body 18 at least the length spout 16 projects from chamber 32 and connects first seal region 38 to second seal region 40. In some examples, third seal region 42 extends laterally across container body 18 between first seal region 38 and second seal region 40 in addition to extending longitudinally across the container body.

When configured as illustrated in FIG. 3, spout 16 is bound on top by first seal region 38, on one lateral side by first side edge 24 of container body 18, and an opposite side by third seal region 42. Second seal region 40 bounds the vertical extent of chamber 32 (e.g., in the Z-direction indicated on FIG. 3) and extends between third seal region 42 and second side edge 26. In the example of FIG. 3, first seal region 38, second seal region 40, and third seal region 42 are continuously joined to form a linear seal extending across the top of container 10 between first side edge 24 and second side edge 26. In other example, the corner of container 10 encompassing second seal region 40 and/or third seal region 42 may be chamfered or otherwise removed such that first seal region 38 does not form a linear seal connection with second side edge 26 through second seal region 40 and third seal region 42. Rather, in these examples, first seal region 38 may extend laterally across container 10 (e.g., in the X-direction indicated on FIG. 3) and connect to third seal region 42 extending longitudinally downwardly (e.g., in the negative Z-direction indicated on FIG. 3) which, in turn, connects to second seal region 40 extending laterally across container 10 at a position lower along the length of container 10 than first seal region 38.

In the configuration of FIGS. 1-3, spout 16 extends vertically upwardly away from chamber 32 and is bound one side by first side edge 24 and on an opposite side by a sealing region where forwardly-facing sidewall 20 is bonded to rearwardly-facing sidewall 22. The sealing region where forwardly-facing sidewall 20 is bonded to rearwardly-facing sidewall 22 extends vertically upwardly (e.g., in the Z-direction indicated on FIGS. 1-3) and, in some examples, is parallel or generally parallel to first side edge 24. For example, the sealing region may have a length (e.g., in the Z-direction indicated on FIGS. 1-3) equal to the length of spout 16. The sealing region bounding the sidewall of spout 16 may further extend laterally (or intersect another sealing region extending laterally) bounding the top of chamber 32 and delimiting the longitudinal extent of the chamber. For example, FIG. 1 illustrates container 10 having a junction 48 where the seal region 35 turns from extending longitudinally (e.g., in the Z-direction indicated on FIG. 1) to bound a sidewall of spout 16 to extending laterally (e.g., in the X-direction indicated on FIG. 1) to bound a top edge of chamber 32. Similarly, FIG. 3 illustrates container 10 having a junction 48 where longitudinally extending third seal region 42 intersects laterally extending second seal region 40.

In some examples, container 10 is configured such that the longitudinal seal region bounding spout 16 opposite first side edge 24 forms a right angle with a lateral seal region bounding the top of chamber 32 between spout 16 and second side edge 26 (e.g., at junction 48). In other examples, the longitudinal seal region forms a non-right angle with the lateral seal region at the junction. For instance, in the example of FIGS. 1-3, the longitudinal seal region bounding spout 16 opposite first side edge 24 is illustrated as intersecting the lateral seal region bounding the top of chamber 32 at junction 48 to define a radius of curvature having a convex curvature facing the spout 16 and/or chamber 32. While the radius of curvature can vary in such configurations, e.g., based on the size of container 10, in some applications, the radius of curvature has a radius ranging from ¾ of an inch (19 millimeters) to 2 inches (51 millimeters), such as approximately 1 inch (25 millimeters).

Configuring container 10 such that the longitudinal seal region bounding spout 16 opposite first side edge 24 forms curved transition with the lateral seal region bounding the top of chamber 32 can be useful to dissipate shock forces that may be generated during transport and handling of the container. In practice, container 10 may contain a small amount of gas (e.g., air) in addition to the food product present within the container. If container 10 is aggressively squeezed or dropped, this gas can compress and rapidly release compression, generating a hydraulic shock force biased outwards against the seal regions of the container. By configuring the longitudinal seal region to have a curved transition with the lateral seal region, hydraulic shock forces can be distributed along the convex of the curvature. This can help prevent a seal failure where side seal forming spout 16 joins the top seal bounding chamber 32.

As mentioned above, forwardly-facing sidewall 20 and rearwardly-facing sidewall 22 can be joined together to bound and delimit the vertical extent of chamber 32 in the region adjacent spout 16. In FIGS. 1 and 2, for example, seal region 35 extends laterally across container body 18 (in the X-direction indicated on FIGS. 1 and 2) from second side edge 26 of container body 18 to the lateral side of spout 16 opposite first side edge 24. This seals the top edge of chamber 32. In FIG. 3, second seal region 40 extends laterally across container body 18 (in the X-direction indicated on FIG. 3) from second side edge 26 of container body 18 to the vertically extending third seal region 42, sealing the top edge of chamber 32.

In some examples, the seal region extending laterally across container body 18 to seal the top of chamber 32 intersects second side edge 26 at a right angle. In this configuration, chamber 32 may define a right angle (90 degree) junction between second side edge 26 and the top edge seal delimiting the vertical extent of the chamber adjacent spout 16. In other examples, the seal region extending across container body 18 to seal the top of chamber 32 can be sloped such that the seal delimiting the vertical extent of chamber 32 intersects second side edge 26 at a non-right angle. This can be useful to help funnel product toward spout 16 when dispensing from container 10, e.g., by preventing product from becoming trapped in a corner of chamber 32 opposite spout 16.

Figure 4:
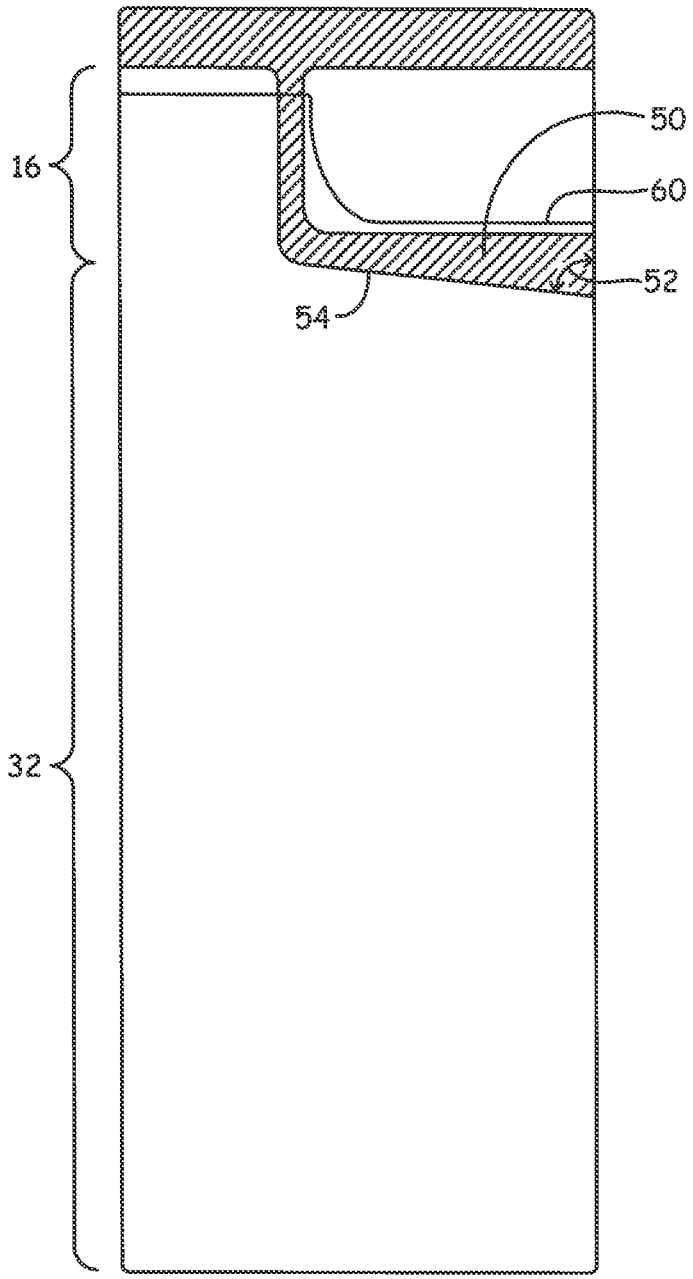
FIG. 4 is a conceptual image showing an example top seal arrangement that can be used on the example containers of FIGS. 1-3.
Figure 4:
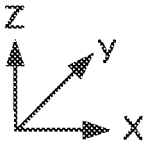

FIG. 4 is a conceptual image showing an example top seal arrangement that can be used on container configurations discussed above with respect to FIGS. 1-3. Like reference numerals in FIG. 4 are intended to refer to like elements discussed above with respect to FIGS. 1-3. As shown in this example, a top seal 50 (e.g., seal region 35, second seal region 40) bounding the top edge of chamber 32 intersects second side edge 26 at a non-right angle 52. Top seal 50 in this example provides a sloped edge 54 facing and bounding the top of chamber 32. Top seal 50 interests second side edge 26 at an angle 52 greater than 90 degrees such that the top edge of chamber 32 slopes upwardly toward spout 16. When pushing product up through container 10 in such a configuration, product moving adjacent second side edge 26 may impinge upon sloped edge 54 and be guided toward spout 16. This can help avoid product getting trapped in a corner formed where top seal 50 intersects second side edge 26.

With further reference to FIGS. 1-3, container 10 includes removable upper section 12 connected to remaining lower section 14 for transport and storage of product within the container. To access the contents of container 10, a user may grasp removable upper section 12 with one hand and remaining lower section 14 with another hand and move the two portions in opposed directions, causing the removable upper portion to break away from remaining lower section. To help separate the two sections at a desired location, container 10 may include a weakened line that tears preferentially to a remainder of the container structure. Accordingly, when a lateral force (e.g., in the X-direction indicated on FIGS. 1-3) is applied to first side edge 24 and/or second side edge 26 of container in the region adjacent spout 16, the container 10 may preferentially separate at the weakened line instead of another location.

Container 10 in the example of FIGS. 1 and 3 is illustrated as including a weakened line 60 that divides the container into removable upper section 12 and remaining lower portion 14 (FIG. 2). Weakened line 60 is illustrated as extending along at least two axes, including across the top of spout 16 and along the side of the spout. For example, in FIG. 1, weakened line 60 starts at or adjacent first side edge 24 and extends laterally across container body 18 (e.g., in the X-direction indicated on FIG. 1). Weakened line 60 then turns and extends longitudinally (e.g., in the Z-direction indicated on FIG. 1) down the length of spout 16, followed by another turn such that the weakened line extends laterally across the container body from spout 16 to second side edge 26. Weakened line 60 is positioned between seal region 36 and spout 16 such that opening container 10 along weakened line 60 forms an aperture though which product can be discharged from spout 16. Weakened line 60 is further positioned within seal region 35 such that opening container 10 along weakened line 60 leaves a seal region bounding the vertical side edge of spout 16 opposite first side edge 24 and also the top edge of chamber 32. This prevents product from discharging from container except through spout 16.

In FIG. 3, weakened line 60 also extends along at least two axes. In particular, weakened line 60 extends laterally across the container body 18 (e.g., in the X-direction indicated in FIG. 3) above second seal region 40 such that some or all of the second seal region remains after separating removable upper section 12 from remaining lower section 14. Weakened line 60 further extends longitudinally across the container body 18 (e.g., in the Z-direction indicated on FIG. 3) on an opposite side of the third seal region 42 from spout 16 such that some or all of the third seal region remains after separating removable upper section 12 from remaining lower section 14. Weakened line 60 yet further extends laterally across the container body 18 below first seal region 38, such that, when the container body 18 is torn open along the weakened line, spout 16 has a dispensing opening at a location previously sealed by first seal region 38.

Configuring container 10 with a weakened line that extends along at least two axes can be useful to protect spout 16 prior to use. For example, removable upper section 12 can surround spout 16 prior to use such that the spout does not project away from a remainder of the container prior to use. Spout 16 can be nested within container body 18 such that removable upper section 12 extends across the top and down the side of the spout. This can help protect the spout from catching and inadvertently tearing open prior to use. By configuring weakened line to extending along at least two axes, the weakened line can extend laterally across the top of spout 16 and generally longitudinally down the side of the spout. As a result, opening container 10 along the weakened line both creates an opening at the top of the spout through which product can be dispensed and removes the protective side of container body 18 such that spout projects away from a remainder of the container structure.

In some examples, weakened line 60 is arranged on container 10 (e.g., in either FIG. 1 and/or FIG. 3) such that the line does not extend directly vertical (e.g., at a 90 degree angle with respect to bottom edge 34) between where the line extends laterally across the top of spout 16 and where the line extends laterally across the container body to second side edge 26. Rather, weakened line 60 may be configured to extend along a continuous radius of curvature connecting the two lateral extents. Such an arrangement may help a user separate the upper removable portion from the lower remaining portion when applying a horizontal tear force (e.g., in the X-direction indicated on FIGS. 1-3).

Weakened line 60 can be formed using any suitable techniques. In various examples, weakened line 60 may be formed by scoring, cutting, burning, or etching the weakened line into container body 18 at a desired location. For example, weakened line 60 may be a laser cut line formed by partial cutting container body 18 to form the line. A starting notch or cut may or may not be made at first side edge 24 and/or second side edge 26 to help a user initiate tearing along the weakened line.

While container 10 can be fabricated from any suitable materials, in some examples, the container is fabricated from a laminate plastic film comprised of multiple plastic film layers joined together. The different layers of the multilayer film can act as a barrier to prevent the ingress and egress of moisture, oxygen, and other gases that can reduce the shelf life of the packaged product. For example, a plastic laminate film may include an inner layer that can be sealed to itself to form seal regions/one or more intermediate (e.g., barrier) layers/and an outer surface layer. As one example according to this configuration, the plastic film may be formed of a polyethylene or polypropylene inner layer/one or more intermediate barrier layers/and an outer layer of polyethylene terephthalate (PET). The foregoing materials are only example, however, and it should be appreciated that the disclosure is not limited in this respect.

Independent of the material(s) used to fabricate container 10, the material can have any suitable thickness. In some examples, the material used to fabricate container 10 is sufficiently thin that the material can be physically bent and deformed under human hand pressure. For example, the material may have a thickness less than 2 millimeters (mm), such as less than 1 mm, less than 0.5 mm, or less than 0.25 mm.

When weakened line 60 is formed as a laser cut line in such an example, the laser may cut through at least the polyethylene terephthalate layer but less than all of the layers forming the container body. The polyethylene terephthalate layer may be the strongest layer within the plastic laminate. Accordingly, cutting through the polyethylene terephthalate layer to form weakened line 60 may help ensure that container 10 preferentially separates at the weakened line and not some other location. Moreover, leaving at least one layer of plastic laminate uncut along weakened line 60 can help ensure the structure integrity of container 10 prior to being opened along weakened line 60.

Figure 5:
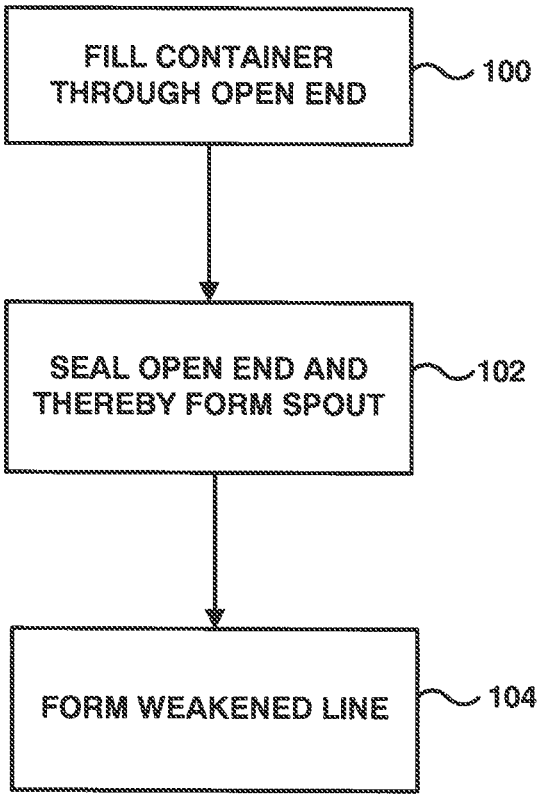
FIG. 5 is a flow chart illustrating an example technique for producing a packaged food product having a container with an integrated spout.

Different container structural designs and configurations have been described in relation to FIGS. 1-4. FIG. 5 is a flow chart illustrating an example technique for producing a packaged food product having a container with an integrated spout. For ease of description, the technique of FIG. 5 is described in conjunction with the example container 10 of FIGS. 1 and 2. In other examples, however, the technique may be performed using other container configurations, as described therein.

As shown in FIG. 5, the example techniques includes filling container 10 with a desired product, such as a viscous human-consumable foodstuff, prior to sealing the top edge of the container to seal the top edge of the container and form spout 16 (100). Container 10 may have a container body 18 shaped as an elongate structure with a length greater than a width. Container body 18 may be sealed on all sides except a top end through which the desired product is introduced prior to sealing.

For example, container body 18 may be formed by taking a single, planar sheet of material (e.g., a plastic laminate) and folding the sheet over upon itself until one edge of the sheet overlaps the opposite edge. The overlapping edges and bottom edges can then be sealed together, e.g., by pressing the edges between sealing jaws (e.g., heated sealing jaws, sonic welding jaws), causing the overlapping edges to melt bond together. The resultant structure can provide container body 18 that is open on the top end, bound on first side edge 24 by the fold in the sheet of material forming the container body, bound on the second side edge 26 by the sealed overlapping edges, and sealed on the bottom edge 34 by the sealed overlapping edges. The product can be introduced into container body 18 through the open top end and filled to a desired height. Alternatively, the top end of the container can first be sealed (as discussed below), product can be introduced into container body 18 through the open bottom end, and the bottom end thereafter sealed.

After filling container 10 with a suitable amount of product (100), the technique of FIG. 5 includes sealing the open top end of the container (102) to close the container and form spout 16. In some example, the forwardly-facing sidewall 20 and rearwardly-facing sidewall 22 are pressed together in the region of the open end, e.g., between sealing jaws, thereby sealing the open end of container body 18 and forming spout 16. When heat sealing jaws are used, the heated sealing jaws can melt bond the inside face of forwardly-facing sidewall 20 to the inside face of rearwardly-facing sidewall 22 to form the seal closing container body 18. The heated sealing jaws can be shaped to form seal regions having the configuration discussed above with respect to FIGS. 1-3, e.g., so that forwardly-facing sidewall 20 is not bonded to rearwardly-facing sidewall 22 in the region of spout 16. Rather, the heated sealing jaws may bond forwardly-facing sidewall 20 to rearwardly-facing sidewall 22 laterally above spout 16 and longitudinally down the side of spout 16, there defining the spout as a distinct structure from the remainder of the container body.

For example, the heated sealing jaws may bond forwardly-facing sidewall 20 to rearwardly-facing sidewall 22 within the top region of the container such that spout 16 is bound on one side by first side edge 24 of container body 18 and further bound by the sealing formed during pressing on an opposite side of the side edge (e.g., seal region 35). The heating sealing jaws may further bond forwardly-facing sidewall 20 to rearwardly-facing sidewall 22 along the top edge of spout 16 (e.g., seal region 36) connecting first side edge 24 to the opposite side of the spout. The resulting spout 16 may extends laterally away from first side edge 24 of container body 18 and downwardly away from the top edge of the spout, thereby expanding in cross-sectional area as the spout moves downwardly from the top edge. In some examples, the heating sealing jaws are configured to bond forwardly-facing sidewall 20 to rearwardly-facing sidewall 22 such that the junction 48 between seal regions 35 and 36 defines a radius of curvature having a convex curvature facing the an interior of chamber 32, e.g., such that any hydraulic shock forces are distributed along the convex curvature.

The technique of FIG. 5 also includes forming a weakened line 60 along at least two axes of container body 18 (104). For example, where container body 18 is fabricated from a multi-layer sheet, a laser or other cutting tool may cut through at least one but less than all of the multiple layers in the sheet. The weakened line 60 may be formed to extend laterally across container body 18 adjacent the top edge of the spout 16 and longitudinally across the container body adjacent the opposite side of the spout from the first side edge 24. This can configure container 10 so that spout 16 opens and extends distally away from a remainder of the container body with removable upper section 12 is separated from remaining lower section 14 via weakened line 60. It should be appreciated that although FIG. 5 illustrates the step of forming weakened line 60 (104) as occurring after the step of sealing the open top end of container 10 (102), this order is for purposes of illustration only. Weakened line 60 may be formed in container 10 prior to sealing the open top end of the container (102). For example, weakened line 60 may be laser cut into a planar sheet of material prior to folding the sheet and sealing the bottom and side edges of the folded sheet so as to form a container that can be filled with product (100).

A container in accordance with the disclosure can provide a portable structure having an integrated spout that can be manually opened (e.g., using only the force of a human hand) without tools or other external implements. The spout can provide a narrower cross-section than a remainder of the container body. For example, the spout may taper in cross-sectional width between the container body and an outlet end of the spout. In use, a consumer can tear off a terminal edge of the container, opening the outlet end of the spout to communicate with a surrounding environment. The consumer can then insert the outlet end of the spout into their mouth and dispense the food product from the container body, through the spout, and into their mouth.

As used herein, terms "upper," "lower," "lateral," "longitudinal," and the like should be understood to refer to relative positions that are intended to facilitate explanation of the invention. For example, the terms "upper," "lower," "lateral," "longitudinal," are generally referred to with respect to an example orientation of container 10 in which the outlet of spout 16 (either before or after removing removable upper section 12) is positioned vertically upwards with respect to gravity (e.g., such that the length of the container is perpendicular with respect to ground). The relative terms "upper," "lower," "lateral," "longitudinal," and the like are not intended to limit the invention to a specific orientation unless otherwise noted. Indeed, it is contemplated that in practice a user may open container 10 by removing removable upper section 12 and invert the container such that outlet of spout 16 is pointed downwardly with respect to gravity. This repositioning can help dispense the contents of the container.

Various examples have been described. These and other examples are within the scope of the following claims.

The invention claimed is:

1. A food product comprising:

an elongated, flexible-wall container body providing a tubular chamber holding a viscous human-consumable foodstuff and having a spout formed by a narrowing of the elongated, flexible-wall container body in a region extending upwardly away from the tubular chamber, wherein the spout is bound on one side by a side edge of the elongated, flexible-wall container body that also bounds the tubular chamber, the spout being further bound on an opposite side of the side edge and on a top edge by a seal joining opposed walls of the elongated, flexible-wall container body together, and wherein the elongated, flexible-wall container body comprises a weakened line extending along two axes, including laterally from the side edge across the elongated, flexible-wall container body adjacent the top edge of the spout, longitudinally across the elongated, flexible-wall container body adjacent the opposite side of the spout from the side edge, and further laterally across the elongated, flexible-wall container body to an opposite side of the elongated, flexible-wall container body.

2. The food product of claim 1, wherein the elongated, flexible-wall container body comprises a single sheet of material folded over upon itself and joined at a side edge seam such that the elongated, flexible-wall container body is bound on one side by the side edge seam and the opposite side by a folded edge of the single sheet of material.

3. The food product of claim 2, wherein the side edge of the elongated, flexible-wall container body bounding the spout is the folded edge of the single sheet of material.

4. The food product of claim 3, wherein the seal further joins a top edge connecting the opposite side of the spout to the side edge seam, the seal joining the top edge connecting the opposite side of the spout to the side edge seam having a sloped edge facing the tubular chamber such that the seal joining the top edge intersects the side edge seam at an angle greater than 90 degrees.

5. The food product of claim 1, wherein the opposite side of the spout extends laterally away from the side edge of the elongated, flexible-wall container body and downwardly away from the top edge of the spout, thereby expanding a cross-sectional area of the spout as the spout moves downwardly from the top edge.

6. The food product of claim 1, wherein the opposite side of the spout defines a radius of curvature having a convex curvature facing the tubular chamber such that any hydraulic shock forces are distributed along the convex curvature.

7. The food product of claim 6, wherein the radius of curvature has a radius ranging from ¾ of an inch (19 millimeters) to 2 inches (51 millimeters).

8. The food product of claim 1, wherein the tear line comprises a laser cut line cutting at least one but less than all of the layers forming the elongated, flexible-wall container body.

9. The food product of claim 1, wherein the viscous human-consumable foodstuff comprises yogurt.

10. The food product of claim 1, wherein the seal comprises a heat seal.

11. A method comprising:

filling an elongated, flexible-wall container with a viscous human-consumable foodstuff through an open end of the elongated, flexible-wall container;

pressing opposed walls of the elongated, flexible-wall container in a region of the open end between sealing jaws, thereby sealing the open end of the elongated, flexible-wall container and forming a spout, the spout being bound on one side by a side edge of the elongated, flexible-wall container and further bound by a seal formed during pressing on an opposite side of the side edge and on a top edge; and forming a weakened line extending along two axes of the elongated, flexible-wall container, including laterally from the side edge across the elongated, flexible-wall container adjacent the top edge of the spout, longitudinally across the elongated, flexible-wall container adjacent the opposite side of the spout from the side edge, and further laterally across the elongated, flexible-wall container to an opposite side of the elongated, flexible-wall container.

12. The method of claim 11, further comprising forming the elongated, flexible-wall container by folding a single sheet of material over upon itself and joining folded halves of the single sheet of material so as to form a side edge seam, the elongated, flexible-wall container being bound on one side by the side edge seam and the opposite side by a folded edge of the single sheet of material.

13. The method of claim 12, wherein pressing opposed walls of the elongated, flexible-wall container in the region of the open end between sealing jaws comprises pressing opposed walls of the elongated, flexible-wall container between sealing jaws such that the side edge of the elongated, flexible-wall container bounding the spout is the folded edge of the single sheet of material.

14. The method of claim 13, wherein pressing opposed walls of the elongated, flexible-wall container in the region of the open end between sealing jaws comprises pressing opposed walls of the elongated, flexible-wall container between sealing jaws to further seal a top edge connecting the opposite side of the spout to the side edge seam, the seal joining the top edge connecting the opposite side of the spout to the side edge seam having a sloped edge such that the seal joining the top edge intersects the side edge seam at an angle greater than 90 degrees.

15. The method of claim 11, wherein pressing opposed walls of the elongated, flexible-wall container in the region of the open end between sealing jaws comprises pressing opposed walls of the elongated, flexible-wall container between sealing jaws such that the opposite side of the spout extends laterally away from the side edge of the elongated, flexible-wall container and downwardly away from the top edge of the spout, thereby expanding a cross-sectional area of the spout as the spout moves downwardly from the top edge.

16. The method of claim 11, wherein pressing opposed walls of the elongated, flexible-wall container in the region of the open end between sealing jaws comprises pressing opposed walls of the elongated, flexible-wall container between sealing jaws such that the opposite side of the spout defines a radius of curvature having a convex curvature facing the an interior of the elongated, flexible-wall container such that any hydraulic shock forces are distributed along the convex curvature.

17. The method of claim 11, wherein the elongated, flexible-wall container is formed of a sheet comprising a plurality of layers, and forming the tear line comprises cutting, with a laser, at least one but less than all of the plurality of layers in the sheet.

18. The method of claim 11, wherein filling the elongated, flexible-wall container with the viscous human-consumable foodstuff comprises filling the elongated, flexible-wall container with yogurt.

19. The method of claim 11, wherein pressing the opposed walls of the elongated, flexible-wall container in a region of the open end between sealing jaws comprises pressing the opposed walls between heated sealing jaws so as to form a heat seal.

20. A container for a human-consumable foodstuff comprising:

an elongated container body having a forwardly-facing sidewall and a rearwardly-facing sidewall that, in combination, bound a chamber for containing a human-consumable foodstuff, the forwardly-facing sidewall and the rearwardly-facing sidewall extending from a lower end of the elongated container body toward an upper end of the elongated container body; and a seal joining the forwardly-facing sidewall to the rearwardly-facing sidewall adjacent the upper end of the elongated container body, the seal including a first seal region extending laterally across the elongated container body at a first location between the upper end and the lower end, a second seal region extending laterally across the elongated container body at a second location positioned closer to the lower end than the first location, and a transition seal region extending longitudinally across the elongated container body and connecting the first seal region to the second seal region, wherein the seal defines a spout bound collectively by a side edge of the elongated container body, the first seal region, and the transition seal region, and the elongated container body comprises a weakened line dividing the elongated body into a removable upper section and a remaining lower section, the weakened line extending laterally across the elongated container body above the second seal region, longitudinally across the elongated container on an opposite side of the transition seal region from the spout, and laterally across the elongated container body below the first seal region, such that, when the elongated container body is torn open along the weakened line, the spout has a dispensing opening at a location previously sealed by the first seal region.

21. The container of claim 20, wherein the forward-facing sidewall and the rearward-facing sidewall comprise a single sheet of flexible material folded over upon itself and joined at a side edge seam such that the elongated container body is bounded on one side by the side edge seam and an opposite side by a folded edge of the flexible material.

22. The container of claim 21, wherein the side edge bounding the spout is the folded edge of the flexible material.

23. The container of claim 22, wherein the second seal region extends from the peripheral edge seam to the transition seal region and the second seal region has a sloped edge facing the chamber of the elongated container body such that the second seal region intersects the side edge seam at an angle greater than 90 degrees.

24. The container of claim 20, wherein the transition seal region further extends laterally across the elongated container body between the first seal region and the second seal region in addition to extending longitudinally across the elongated container body, the transition seal region defining a radius of curvature having a convex curvature facing the chamber of the elongated container body such that any hydraulic shock forces are distributed along the convex curvature in the transition seal region.

25. The container of claim 20, wherein the spout has a length extending from a lower edge of the second seal to a lower edge of the first seal and a width extending from the side edge of the elongated container body to an opposed side edge of the transition seal, and wherein the weakened line crosses the seal within the transition seal region.

* * * * *